US012157066B2

(12) United States Patent
Conway

(10) Patent No.: US 12,157,066 B2
(45) Date of Patent: Dec. 3, 2024

(54) TOY VEHICLE WITH MODULAR SEAT

(71) Applicant: Roboskull, LLC, Stewartville, MN (US)

(72) Inventor: Benjamin Saintmane Conway, Rochester, MN (US)

(73) Assignee: Roboskull, LLC, Stewartville, MN (US)

( * ) Notice: Subject to any disclaimer, the term of this patent is extended or adjusted under 35 U.S.C. 154(b) by 235 days.

(21) Appl. No.: 17/670,077

(22) Filed: Feb. 11, 2022

(65) Prior Publication Data

US 2023/0256355 A1 Aug. 17, 2023

(51) Int. Cl.

| | |
|---|---|
| ***A63H 17/26*** | (2006.01) |
| ***A63H 27/18*** | (2006.01) |
| ***A63H 27/26*** | (2006.01) |
| ***A63H 33/10*** | (2006.01) |

(52) U.S. Cl.

CPC ..... *A63H 27/06* (2013.01); *A63H 33/108* (2013.01)

(58) Field of Classification Search

CPC ..... A63H 17/00; A63H 17/002; A63H 17/26; A63H 27/00; A63H 27/001; A63H 33/00; A63H 33/003; A63H 33/108; B62B 5/082; B62B 3/007; B62B 2202/52

USPC ..... 446/56, 93, 94, 95, 465, 470, 34; 296/10, 193.04

See application file for complete search history.

(56) References Cited

U.S. PATENT DOCUMENTS

| | | | | |
|---|---|---|---|---|
| 1,665,469 | A * | 4/1928 | Myers | B62K 9/02 280/1.12 |
| 4,842,326 | A * | 6/1989 | DiVito | B60P 3/42 296/10 |
| 5,167,563 | A * | 12/1992 | Saffer | A63H 17/262 446/466 |
| 5,810,638 | A * | 9/1998 | Wood | A63H 11/10 446/470 |
| 6,203,393 | B1 * | 3/2001 | Flynn | A63H 23/005 446/77 |
| 6,346,025 | B1 * | 2/2002 | Tachau | A63H 17/34 403/114 |

(Continued)

OTHER PUBLICATIONS

Innerspaceonline.com [online], "Battle Cruiser," available on or before Jul. 12, 2002, retrieved on Dec. 1, 2021, retrieved from URL<https://www.innerspaceonline.com/battlecruise.htm/>, 3 pages.

(Continued)

*Primary Examiner* — Alexander R Niconovich
(74) *Attorney, Agent, or Firm* — Fish & Richardson P.C.

(57) ABSTRACT

The subject matter of this specification can be embodied in, among other things, a modular toy vehicle that includes a vehicle body defining a seat space that is at least partially enclosed and defines an interior volume to contain one or more character figures, a first character seat assembly removably mountable to the vehicle body within the seat space as a first simulated seat, and a second character seat assembly removably mountable to the vehicle body within the seat space as a second simulated seat that is sized differently from the first simulated seat such that the second character seat assembly is prevented from removably mounting to the vehicle body within the seat space when the first character seat assembly is removably mounted to the vehicle body within the seat space.

17 Claims, 10 Drawing Sheets

(56) References Cited

U.S. PATENT DOCUMENTS

| | | | | |
|---|---|---|---|---|
| 7,017,937 | B2 * | 3/2006 | Williams | B60N 2/2848 280/642 |
| 7,950,979 | B2 * | 5/2011 | Barthold | A63H 17/26 446/470 |
| 8,894,031 | B2 * | 11/2014 | Sailer | B60N 2/01 296/65.11 |
| 8,955,855 | B2 * | 2/2015 | Herlitz | B62B 9/108 280/47.38 |
| 9,469,324 | B2 * | 10/2016 | Bowman | B62B 3/022 |
| 9,579,585 | B2 * | 2/2017 | Silverglate | A63H 17/26 |
| 9,795,892 | B2 * | 10/2017 | Silverglate | A63H 17/38 |
| 9,855,860 | B2 * | 1/2018 | Ahn | B60N 2/005 |
| 10,077,062 | B2 * | 9/2018 | Bowman | B62B 5/082 |
| 10,189,373 | B2 * | 1/2019 | Thomas | B60N 2/01 |
| 2001/0051488 | A1 * | 12/2001 | Tachau | A63H 17/34 446/397 |
| 2007/0037480 | A1 * | 2/2007 | Jarck | A63H 17/002 446/470 |
| 2008/0284214 | A1 * | 11/2008 | Neale | B60N 2/06 297/15 |
| 2020/0353963 | A1 * | 11/2020 | Kramer | B62B 5/061 |
| 2022/0340052 | A1 * | 10/2022 | Harmon | B60N 2/3061 |

OTHER PUBLICATIONS theFwoosh.com [online], "Throwback Review: Tim Mee Toys Super Defender Copter," available on or before Oct. 31, 2019, retrieved on Dec. 1, 2021, retrieved from URL<http://thefwoosh.com/2017/12/throwback-review-tim-mee-toys-super-defender-copter/>, 7 pages.

* cited by examiner

TOY VEHICLE WITH MODULAR SEAT

TECHNICAL FIELD

This instant specification relates to toy vehicles, and particularly, to those which can accommodate a toy occupant.

BACKGROUND

Many toy action figures are built to two common sizes: the so-called "1:18 scale" (e.g., where the toys are about 4 inches tall), and "1:12 scale" (e.g., where the toys are about 6 inches tall).

Toy vehicles that generally are miniaturized versions of full-size vehicles, either real or fictional, have proven to be an extremely popular type of toy among toy enthusiasts for many years. Many such toy vehicles are designed to accommodate toy pilots or drivers (e.g., action figures, dolls). As such, many toy vehicles are built to a similar scale as the action figures that they are meant to carry. The scale of the vehicles includes the seats, which are designed to a single scale in order to fit and have an appropriate appearance in relation to the size of the action figures that are meant to sit on the seats.

SUMMARY

In general, this document describes toy vehicles with interchangeable seats that can accommodate toy occupants of various sizes. In some implementations, the toy vehicle can be configured to receive any of two or more seat assemblies for releasable attachment to the vehicle. Optionally, the different seat assemblies can be configured with different scales in order to accommodate and provide an improved aesthetic appearance when used with toy characters of different sizes and scales. For example, the same vehicle can interchangeably receive a 1:12 scale seat assembly to seat a 1:12 scale action figure, and upon removal of the 1:12 scale seat, can then receive a 1:18 scale seat in order to seat a 1:18 scale action figure. Accordingly, particular embodiments described herein can achieve a toy vehicle that can be advantageously fitted to, and used with, multiple lines of action figures having different scales.

In an example embodiment, a modular vehicle includes a vehicle body defining a seat space that is at least partially enclosed and defines an interior volume to contain one or more character figures, a first character seat assembly removably mountable to the vehicle body within the seat space as a first simulated seat, and a second character seat assembly removably mountable to the vehicle body within the seat space as a second simulated seat that is sized differently from the first simulated seat such that the second character seat assembly is prevented from removably mounting to the vehicle body within the seat space when the first character seat assembly is removably mounted to the vehicle body within the seat space.

Various embodiments can include some, all, or none of the following features. The seat space of the vehicle body can be sized to interchangeably receive a selected one of the first character seat assembly and the second character seat assembly. The interior volume defined by the seat space can be a fixed interior volume bounded by one or more fixed walls of the vehicle body, and the fixed interior volume can limit insertion of the second character seat assembly within the seat space when the first character seat assembly is removably mounted to the vehicle body within the seat space. The seat space defined by the vehicle body can simulate a vehicle cockpit configured to receive the one or more character figures associated with the vehicle body. The modular vehicle can include a door configured to open to provide access to the seat space and close to at least partly enclose the seat space. The first simulated seat can be configured with a first scale that is proportional to a first range of scale of a first simulated anthropomorphic vehicle occupant. The first range of scale can be about 1:12 scale. The first simulated anthropomorphic vehicle occupant can have a height of about five inches to about seven inches. The second simulated seat can be configured with a second scale that is proportional to a second range of scale of a second simulated anthropomorphic vehicle occupant. The second range of scale can be about 1:18 scale. The second simulated anthropomorphic vehicle occupant can have a height of about 3.5 inches and about 4.25 inches. The second character seat assembly can further define both the second simulated seat and a third simulated seat. The vehicle body can include a collection one or more first attachment points within the seat space, the first character seat assembly comprises a collection of one or more second attachment points configured to releasably connect with one or more of the first attachment points for removably mounting the first character seat assembly to the vehicle body, and the second character seat assembly can include a collection of one or more third attachment points configured to releasably connect with one or more of the first attachment points for removably mounting the second character seat assembly to the vehicle body. The vehicle body can have an exterior shape of a winged spacecraft that includes one or more adjustable wing assemblies.

In an example implementation, a method of assembling a modular vehicle includes providing a vehicle body defining a seat space that is at least partially enclosed and defines an interior volume to contain one or more character figures, providing a first character seat assembly, providing a second character seat assembly, assembling the first character seat assembly within the seat space as a first simulated seat, preventing, by the assembly of the first character seat assembly within the seat space, assembly of the second character seat assembly within the seat space, removing the first character seat assembly from the seat space, assembling the second character seat assembly to the vehicle body as a second simulated seat, preventing, by the assembly of the second character seat assembly within the seat space, assembly of the first character seat assembly within the seat space, and removing the second character seat assembly from the seat space.

Various implementations can include some, all, or none of the following features. The method can include arranging a first simulated anthropomorphic vehicle occupant upon the first simulated seat, wherein the first simulated seat is configured with a scale that is proportional to the first simulated anthropomorphic vehicle occupant. The method can include arranging a second simulated anthropomorphic vehicle occupant upon the second simulated seat, wherein the second simulated seat is configured with a scale that is proportional to the second simulated anthropomorphic vehicle occupant. The method can include arranging a third simulated anthropomorphic vehicle occupant upon a third simulated seat, wherein the second character seat assembly comprises the third simulated seat configured with a scale that is proportional to the third simulated anthropomorphic vehicle occupant. The method can include opening a door of a seat space defined by the vehicle body configured as a simulated cockpit of the modular vehicle, the door being configured to open to provide access to the seat space, and closing the door to at least partly enclose the first character seat assembly or the second character seat assembly within the seat space.

In another example embodiment, a toy includes a first means for seating anthropomorphic toys having a first scale, a second means for seating anthropomorphic toys having a second scale different from the first scale, and means for interchangeably receiving the first means for seating anthropomorphic toys and the second means for seating anthropomorphic toys at least partly on or at least partly within a modular base.

The systems and techniques described here may provide one or more of the following advantages. First, a system can provide a toy vehicle that is compatible with two or more sizes of toy occupants. Second, the system can provide enhanced functionality and play value by being compatible with a wider range of toy sizes. Third, the system can provide enhanced ownership value and appeal by being compatible with a wider range of toy sizes.

The details of one or more implementations are set forth in the accompanying drawings and the description below. Other features and advantages will be apparent from the description and drawings, and from the claims.

DETAILED DESCRIPTION

This document describes toy vehicles that have multiple interchangeable seats that are sized to accommodate toy characters (e.g., action figures, dolls, figurines, toy occupants) of different sizes and/or scales. In the world of action figures, humanoid toy product lines are often built to two commonly-used scales: the so-called "1:18 scale" in which the toys are about 4 inches tall, and "1:12 scale" in which the toys are about 6 inches tall. Traditionally, the vehicles that are built for these product lines are built to a similar scale, with seats that approximate the scale of the action figures that were intended to be seated upon them. In such prior examples, a 1:12 scale occupant would look ridiculously big (and might not even fit at all) in a 1:18 scale seat, and/or a 1:18 scale occupant would look ridiculously small in a 1:12 scale seat (e.g., the figure may appear to be unable to see over the dashboard or out the windows). As such, these prior toy vehicles are generally limited to being used only with toy characters of a single scale.

Some embodiments of the toy vehicles described in this document include two or more seat assemblies that can be interchangeably assembled to the vehicle. The different seat assemblies are configured with different scales in order to accommodate and give a preferred aesthetic appearance when used with toy characters of different sizes and scales. For example, a 1:12 scale seat assembly can be inserted into the vehicle to seat a 1:12 scale action figure, and then removed and interchanged with a 1:18 scale seat in order to seat a 1:18 scale action figure within the same vehicle. As such, the toy vehicles described in this document can be used with multiple lines of action figures having different scales, and can extend the versatility, compatibility, and play value of the toy vehicle across multiple different product lines.

Figure 1:
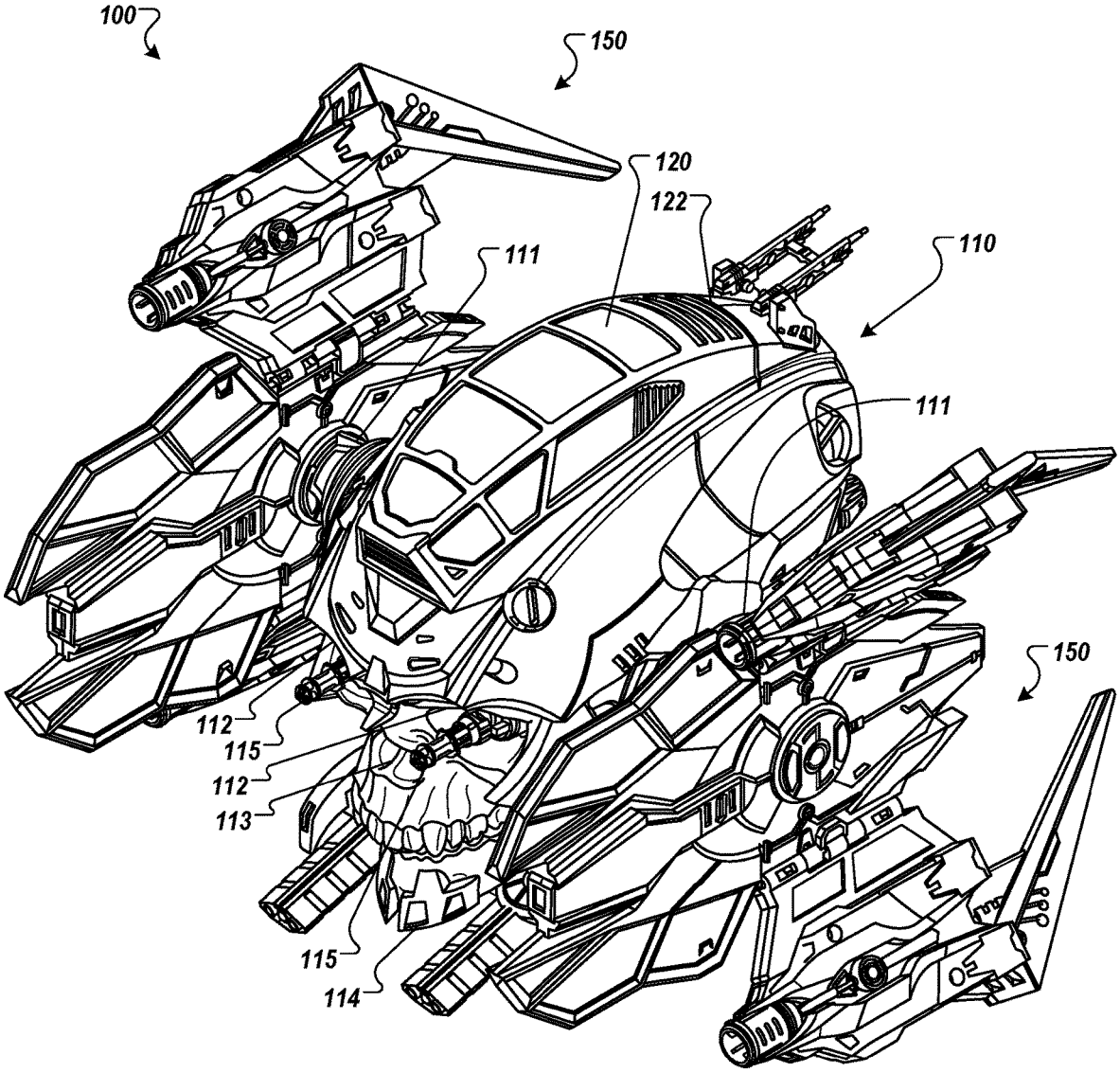
FIG. 1 is perspective view of an example toy vehicle.

FIG. 1 is perspective view of an example toy vehicle 100, which is also shown in various plan views in FIGS. 7-12. In this depicted embodiment, the toy vehicle 100 simulates a winged spacecraft that has a vehicle body 110 that is shaped like a stylized human skull, and with a pair of wing assemblies 150 rotatably affixed to sides 111 of the vehicle body 110 (e.g., approximately where ears would be on a real skull of head). The wing assemblies 150 will be discussed in more detail in the descriptions of FIGS. 13A-15. In other embodiments, the toy vehicle may take the form of a road vehicle, military vehicle, boat, submersible vehicle, flying vehicle, or a combination thereof.

The vehicle body 110 also includes features that are configured to emulate the appearance of eye sockets 112, a nasal opening 113, and a jaw assembly 114 that is configured to emulate the appearance and movement of a human jaw. In the illustrated example, removable turrets 115 are mounted to and extend outward from the eye sockets 112.

A cockpit door 120 defines a portion of the top of the vehicle body 110. The cockpit door 120 is moveably affixed to the vehicle body 110 by a hinge 122. The hinge 122 is configured to hingedly connect (e.g., to pivotably affix, as with a hinge) the cockpit door 120 to the vehicle body 110, and is configured permit the cockpit door 120 to open and close. The cockpit door 120 will be discussed in more detail in the description of FIG. 2.

Figure 2:
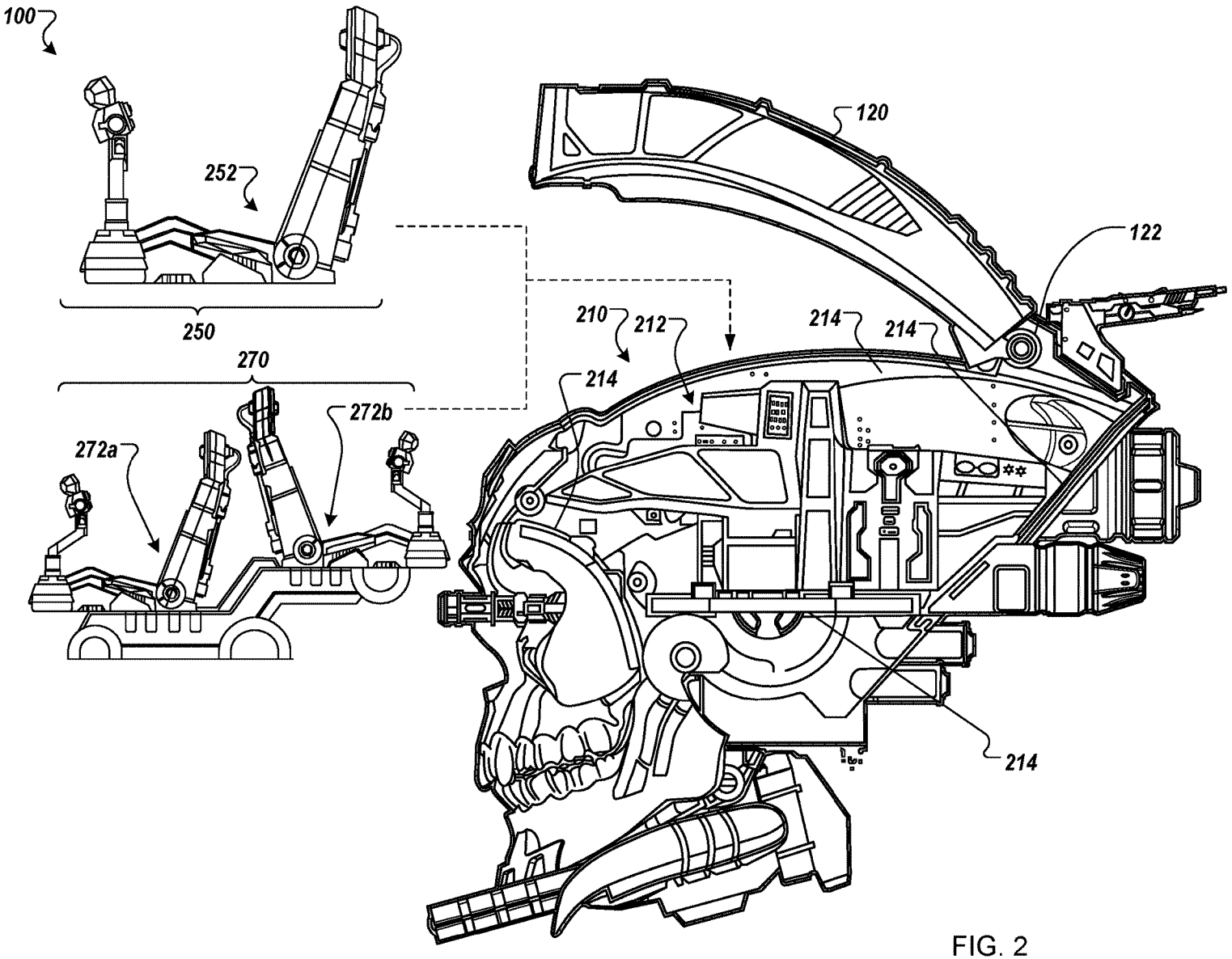
FIG. 2 is partial cutaway side view of the example toy vehicle of FIG. 1, with an exploded two of two interchangeable character seat assembles.

FIG. 2 is partial cutaway side view of the example toy vehicle 100 of FIG. 1. In the illustrated example, the cockpit door 120 is shown in an open configuration. The vehicle body 110 defines a seat space 210 that is at least partially enclosed and defines an interior volume 212 to contain one or more character figures (not shown in this view). The seat space 210 provides a modular base for interchangeable, module attachment of the character seat assemblies 250, 270. In some embodiments, the seat space 210 defined by the vehicle body 110 can simulate a vehicle cockpit configured to receive one or more character figures associated with the vehicle body 110. The cockpit door 120 is configured to open to provide access to the seat space 210 and close to at least partly enclose the seat space 210.

The toy vehicle 100 includes a character seat assembly 250 that is removably mountable to the vehicle body 110 within the seat space 210 as a simulated seat 252. The toy vehicle 100 also includes a character seat assembly 270 that is removably mountable to the vehicle body 110 within the seat space 210 as a simulated seat 272*a* and a simulated seat 272*b*.

The seat space 210 of the vehicle body 110 is sized to interchangeably receive a selected one of the character seat assembly 250 and the character seat assembly 270. The interior volume 212 defined by the seat space 210 is a fixed interior volume bounded by one or more fixed walls 214 of the vehicle body 110, and the fixed interior volume limits insertion of the character seat assembly 270 within the seat space 210 when the character seat assembly 250 is removably mounted to the vehicle body 110 within the seat space 210.

Figure 3A:
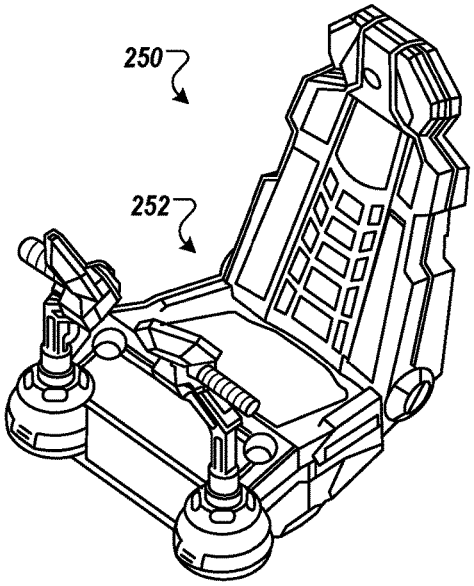
FIGS. 3A-4B are perspective views of the example interchangeable seat assemblies of FIG. 2, with and without example toy characters seated in them.
Figure 3B:
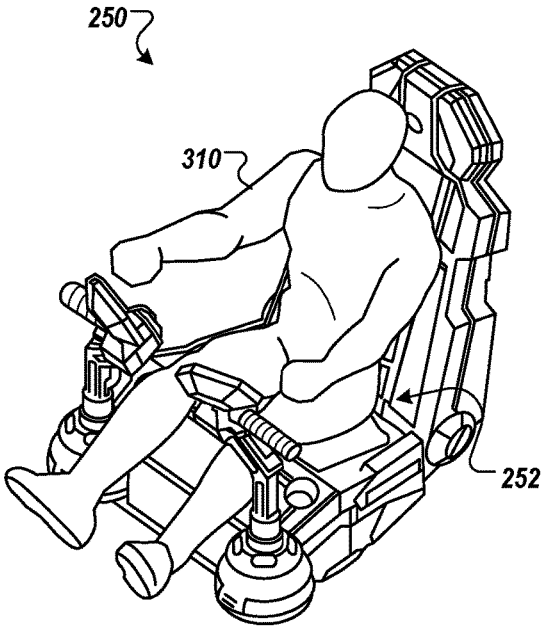

FIG. 3A is a perspective view of the example character seat assembly 250 of FIG. 2. FIG. 3B is a perspective view of the example character seat assembly 250 with an example toy character 310 seated upon the character seat assembly 250. In the illustrated example, the toy character 310 is configured as a simulated anthropomorphic vehicle occupant (e.g., a pilot, a passenger). The simulated seat 252 is configured with a scale that is proportional to a range of scale of the toy character 310 or other simulated anthropomorphic vehicle occupant. In the illustrated example, the first range of scale is about 1:12 scale. For example, the toy character 310 or other simulated anthropomorphic vehicle occupant can have a height of about five inches to about seven inches. In some embodiments, the character seat assembly 250 can include more than the one simulated seat 252. For example, the character seat assembly 250 can include one, two, three, or any other appropriate number of simulated seats.

Figure 4A:
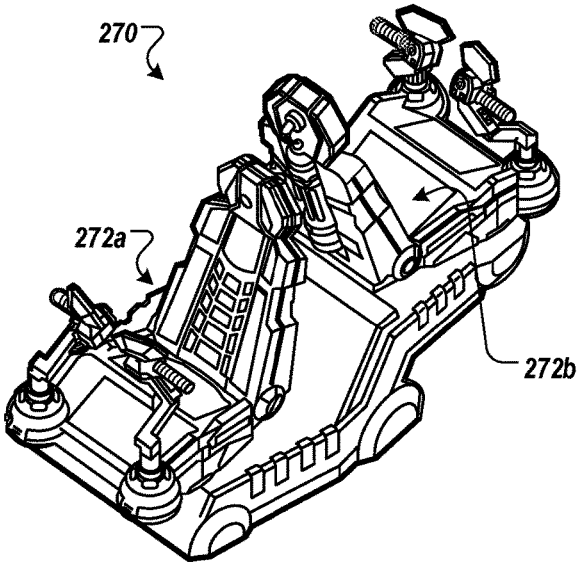
Figure 4B:
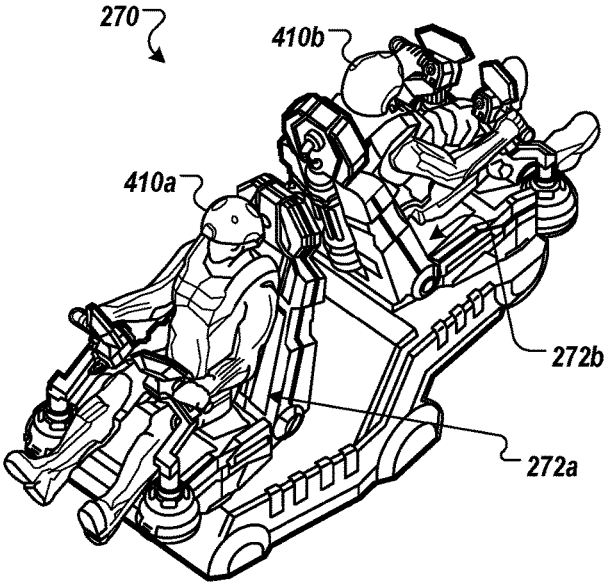

FIG. 4A is a perspective view of the example character seat assembly 270 of FIG. 2. FIG. 4B is a perspective view of the example character seat assembly 270 with an example toy character 410*a* and an example toy character 410*b* seated upon the character seat assembly 270. In the illustrated example, the toy characters 410*a*, 410*b* are configured as simulated anthropomorphic vehicle occupants (e.g., two pilots, a pilot plus navigator, tail gunner, or passenger). The simulated seats 272*a*, 272*b* are configured with a scale that is proportional to a range of scale of the toy characters 410*a*, 410*b* or other simulated anthropomorphic vehicle occupant. In the illustrated example, the first range of scale is about 1:18 scale. For example, the toy characters 410*a*, 410*b*, or other simulated anthropomorphic vehicle occupants can have a height of about 3.5 inches to about 4.25 inches. In some embodiments, the character seat assembly 270 can include more or fewer than the two simulated seats 272*a*, 272*b*. For example, the character seat assembly 270 can include one, two, three, or any other appropriate number of simulated seats.

Figure 5A:
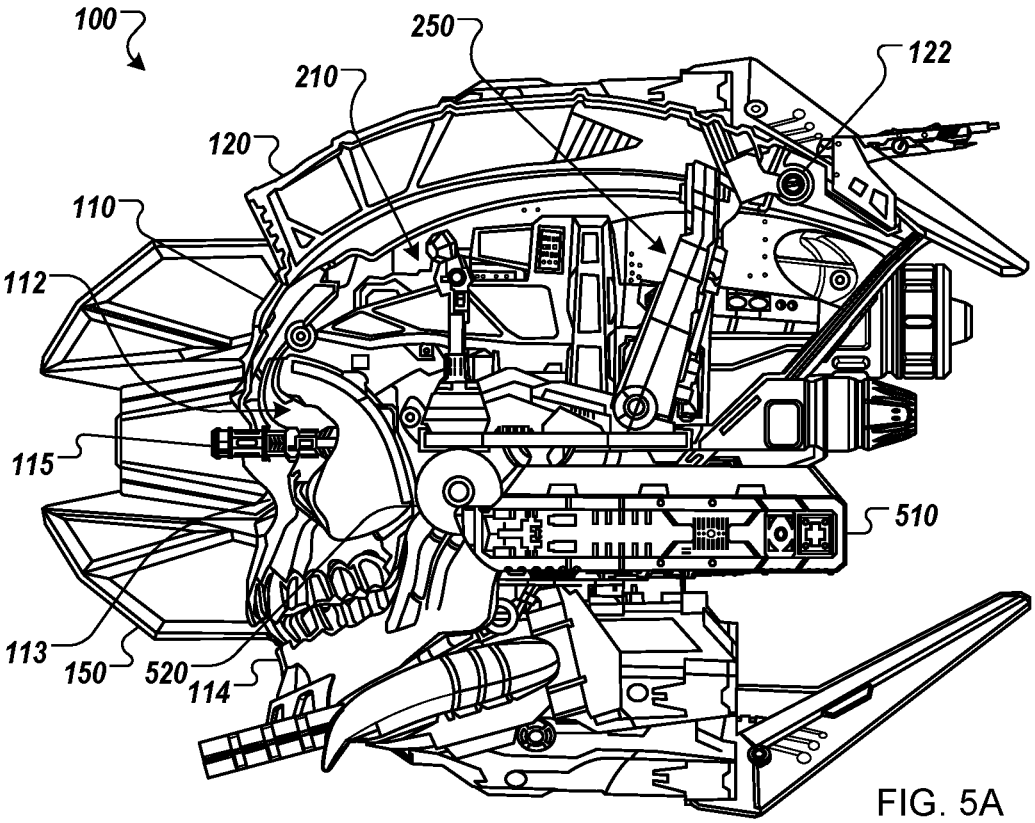
FIGS. 5A and 5B are partial cutaway side view of the example toy vehicle of FIG. 1, assembled with the example interchangeable character seat assemblies.
Figure 5B:
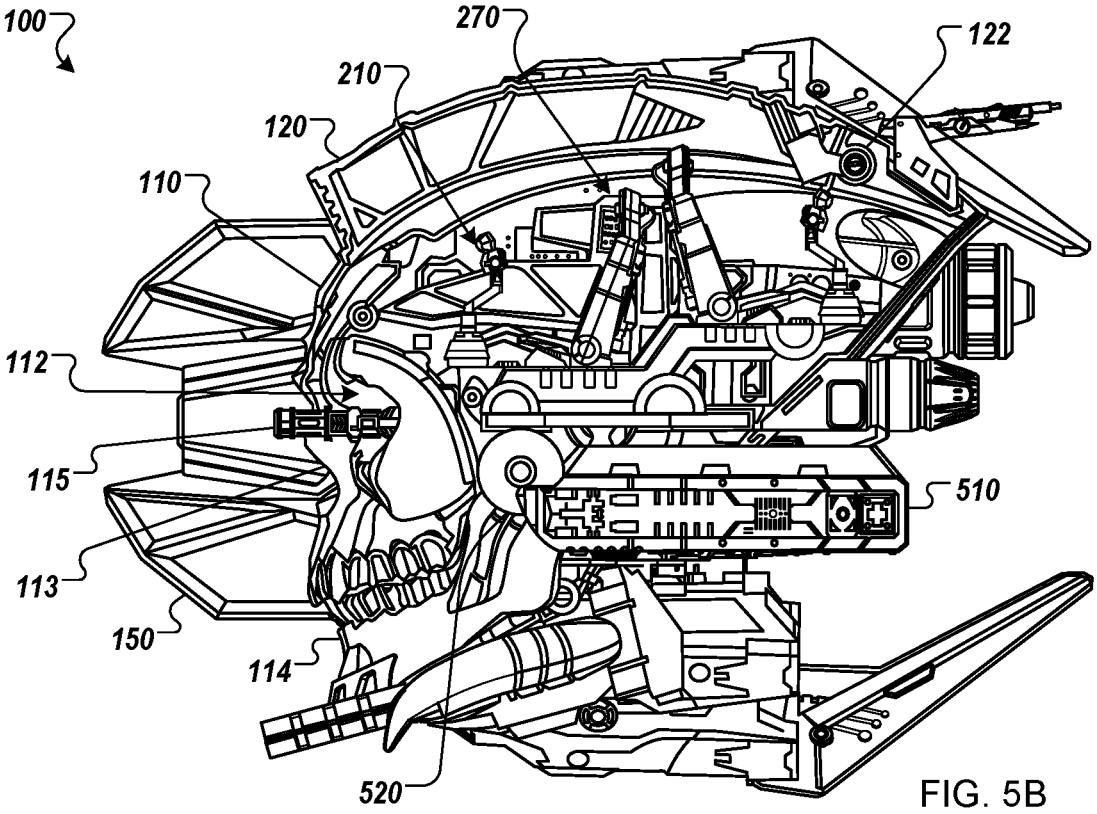

FIG. 5A is partial cutaway side view of the example toy vehicle 100 of FIG. 1, assembled with the example character seat assembly 250. FIG. 5B is partial cutaway side view of the example toy vehicle 100, assembled with the example character seat assembly 270. The character seat assembly 270 is sized differently from the character seat assembly 250 such that the character seat assembly 270 is prevented from removably mounting to the vehicle body 110 within the seat space 210 when the character seat assembly 250 is removably mounted to the vehicle body 110 within the seat space 210. For example, when the character seat assembly 250 is inserted in the cockpit of the toy vehicle 100, the character seat assembly 270 cannot also fit into the cockpit at the same time, and when the character seat assembly 270 is inserted in the cockpit of the toy vehicle 100, the character seat assembly 250 cannot also fit into the cockpit at the same time.

Also visible in FIGS. 5A and 5B is a removable cargo pod 510. For example, the removable cargo pod 510 may be released from the vehicle body 110 by pulling it rearward, and opened to reveal an internal cavity (not shown) that can be used to transport simulated cargo or passengers. The removable cargo pod 510 can then be reassembled into the vehicle body for simulated transport.

Also visible in FIGS. 5A and 5B is a jaw hinge 520. The jaw assembly 114 is moveably affixed to the vehicle body 110 by the jaw hinge 520, to permit the jaw assembly 114 to open and close (e.g., like a human jaw).

Figure 6A:
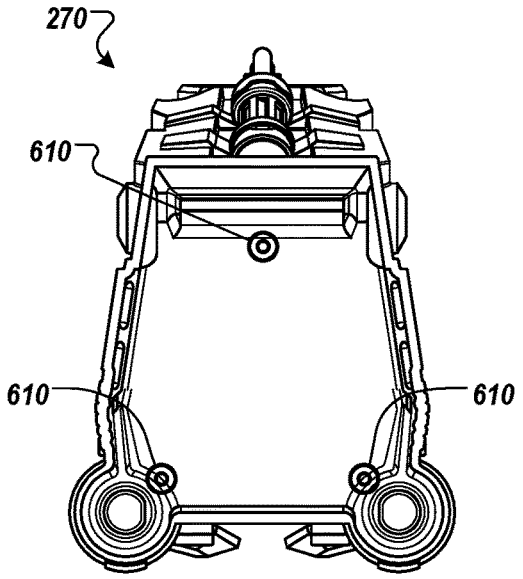
FIGS. 6A and 6B are bottom views of example attachment points for mounting the example interchangeable character seat assembles to the toy vehicle.
Figure 6B:
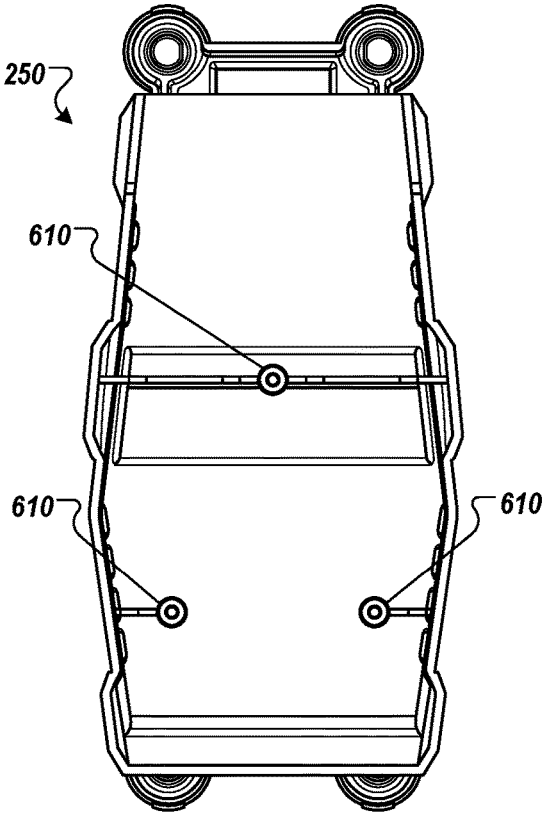
Figure 6C:
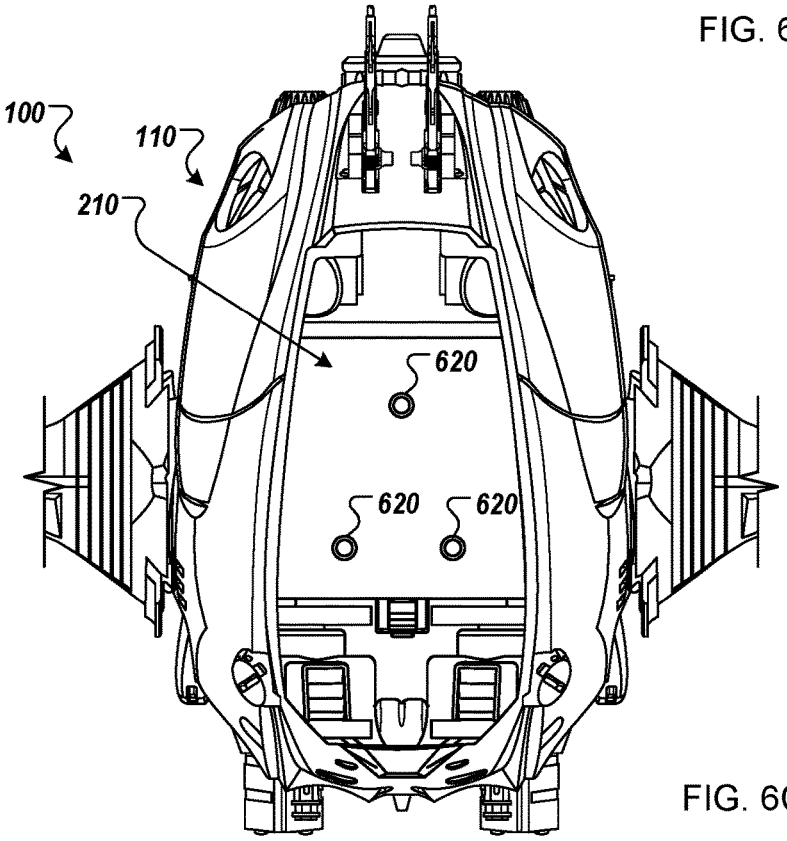
FIG. 6C is a top view of example seat attachment points in the toy vehicle.
Figure 7:
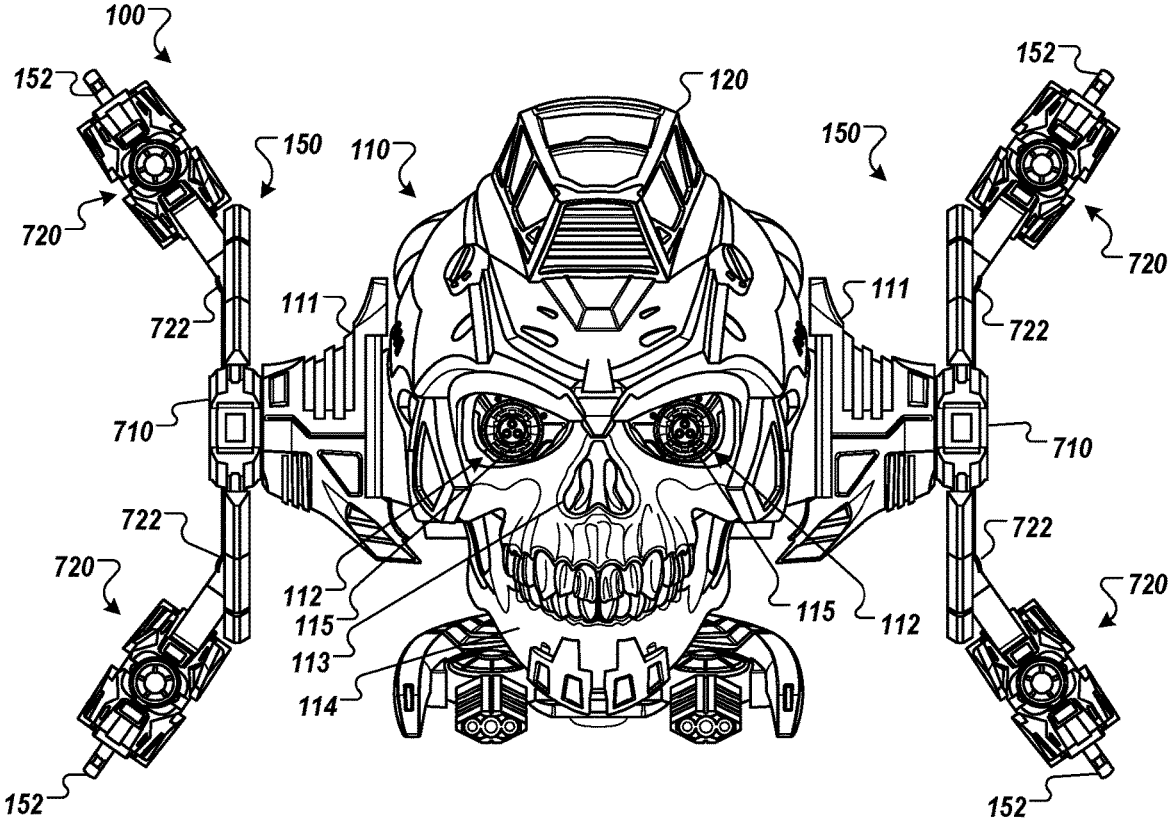
FIG. 7 is a front view of the example toy vehicle of FIG. 1.
Figure 8:
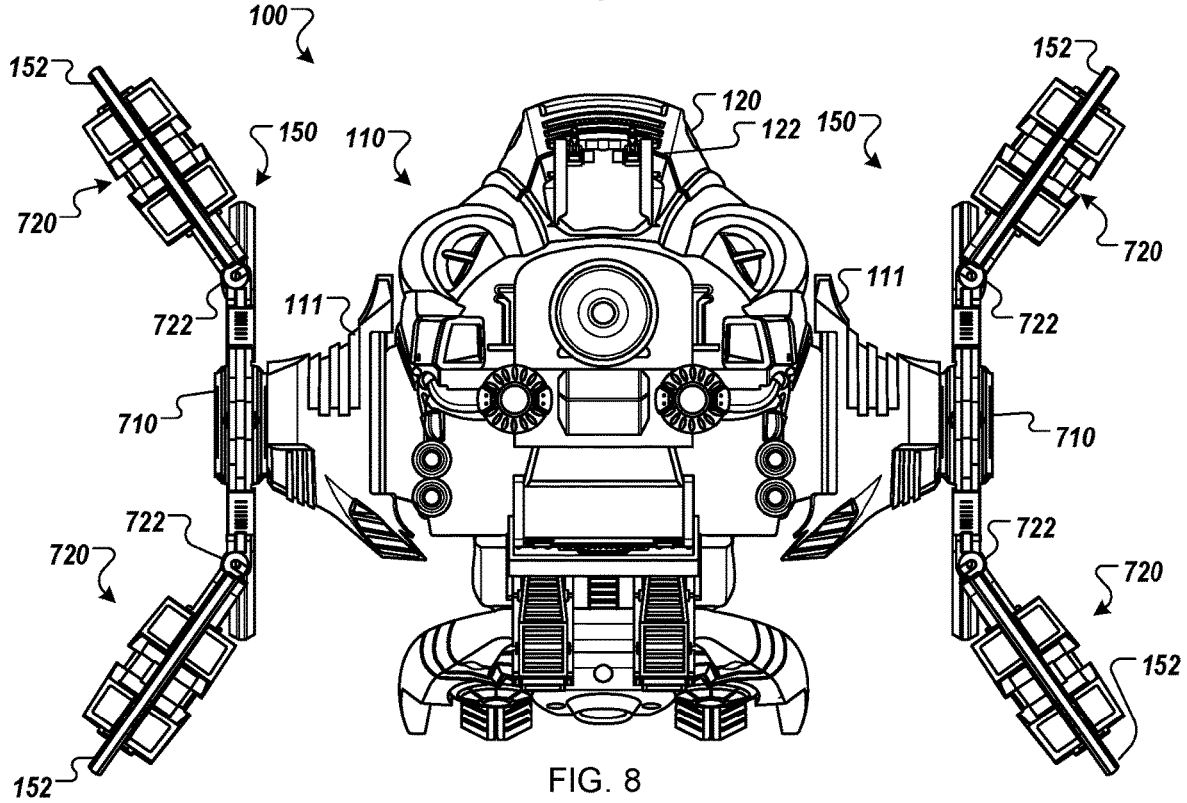
FIG. 8 is a rear view of the example toy vehicle of FIG. 1.
Figure 9:
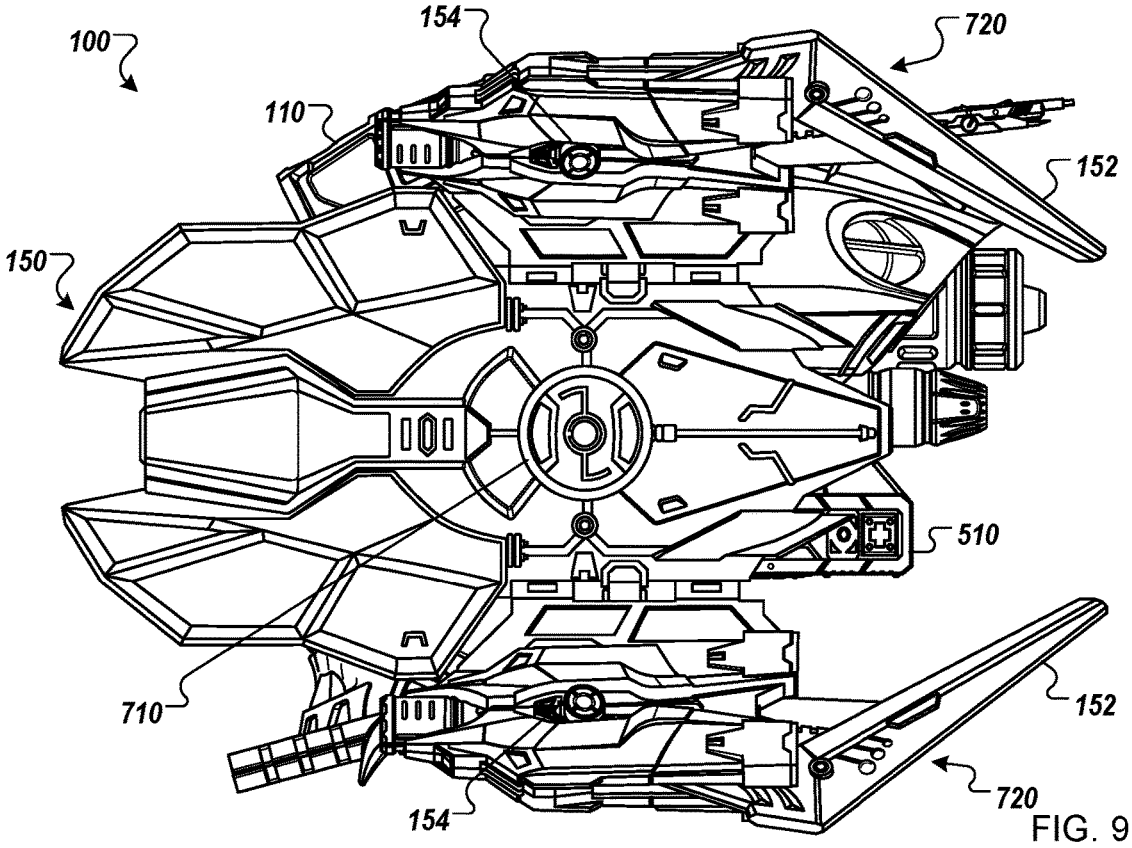
FIG. 9 is a right side view of the example toy vehicle of FIG. 1.
Figure 10:
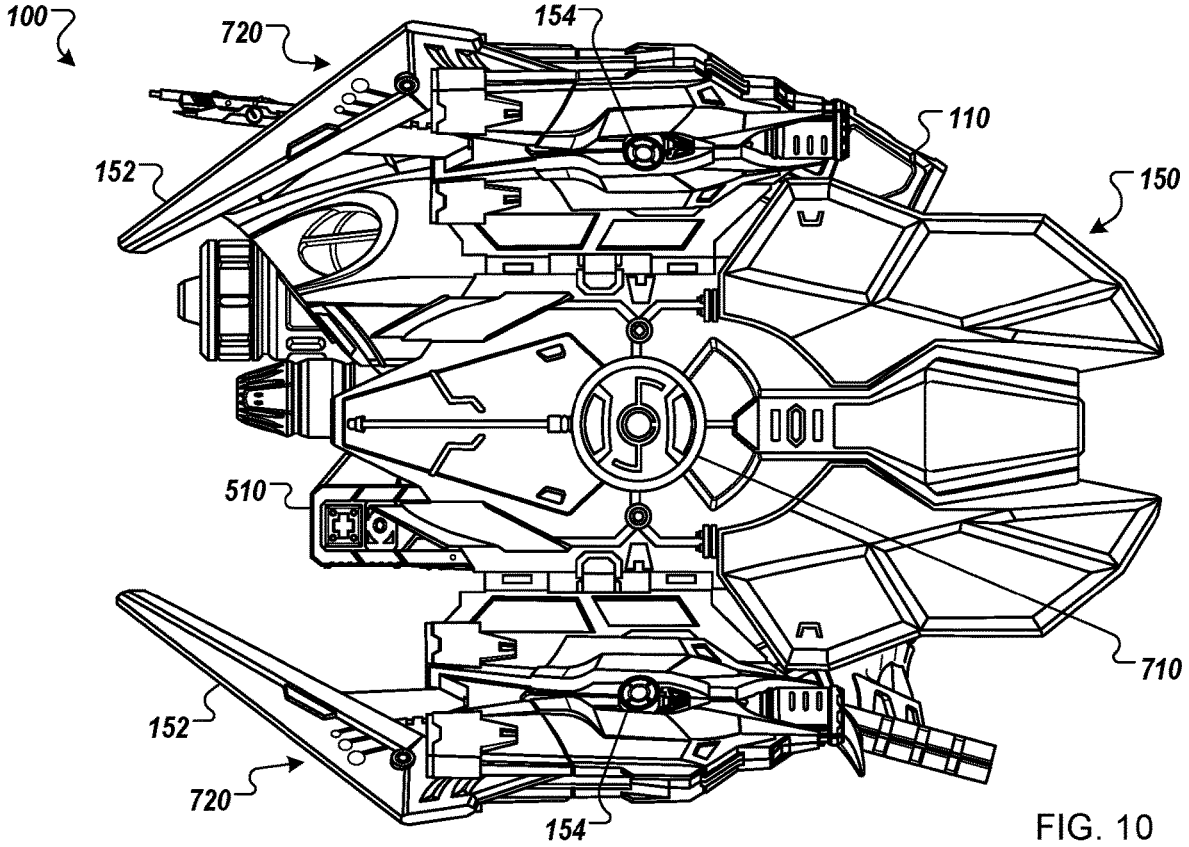
FIG. 10 is a left side view of the example toy vehicle of FIG. 1.
Figure 11:
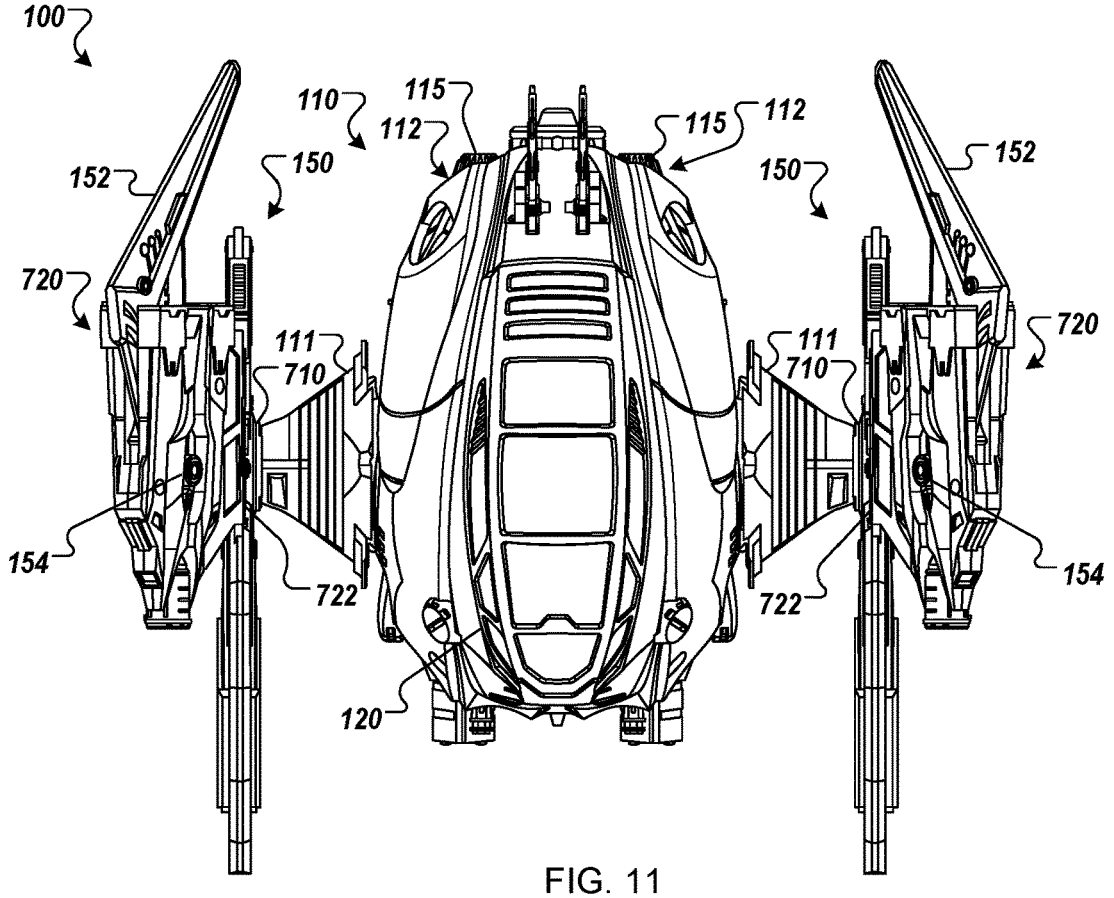
FIG. 11 is a top view of the example toy vehicle of FIG. 1.
Figure 12:
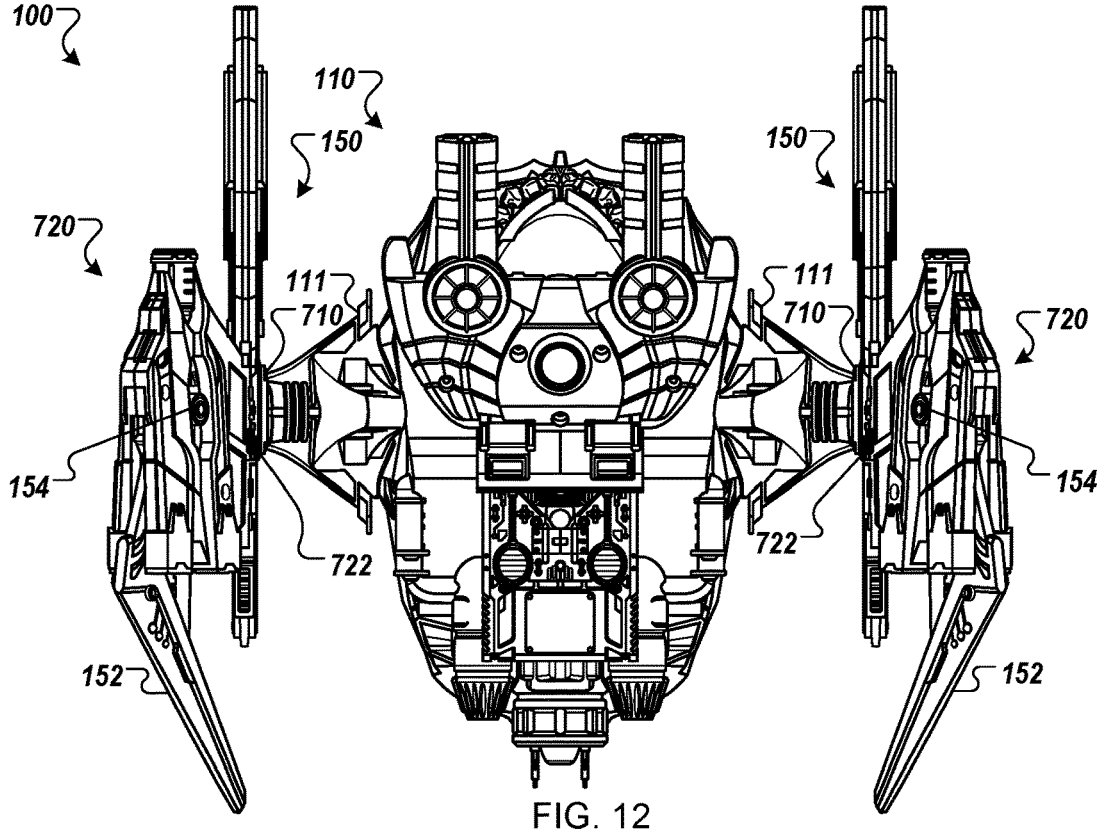
FIG. 12 is a bottom view of the example toy vehicle of FIG. 1.

FIG. 6A is a bottom view of example attachment points for mounting the example character seat assembly 270 to the example toy vehicle 100 of FIG. 1. FIG. 6B is a bottom view of example attachment points for mounting the example character seat assembly 250 to the example toy vehicle 100. FIG. 6C is a top view of example seat attachment points in the example seat space 210 of the example toy vehicle 100.

The character seat assemblies 250 and 270 both include a collection of attachment points 610. The attachment points 610 are configured to removably connect with, mate with, or otherwise be releasably connect to a collection of complimentary attachment points 620 defined within the seat space 210 (e.g., on the floor) for removably mounting the selected character seat assembly to the vehicle body 110. In some embodiments, the attachment points 610 and 620 can be configured as a dowel-and-socket arrangement in which friction provides a retaining force between the character seat assembly 250, 270 in use and the vehicle body 110. In some embodiments, the attachment points 610 and 620 can include magnets and/or ferrous metals in which magnetic attraction provides the retaining force. In some embodiments, tabs, slots, suction cups, latches, removable fasteners, or combinations of these any other appropriate form of retention structure can be used.

In use, one of the character seat assemblies 250, 270 can be selected for use in the toy vehicle 100 and then removed to permit use of the other of the seat assemblies. For example, the character seat assembly 250 may be inserted into the seat space 210 to provide an appropriately sized seat for a relatively larger (e.g., 1:12 scale) occupant, such as the toy character 310. The character seat assembly 250 can remain held in place during play by the attachment points 610 and 620 until the user decides to remove the character seat assembly 250 and insert the character seat assembly 270 into the seat space instead to provide one or more appropriately sized seats for one or more relatively smaller (e.g., 1:18 scale) occupants, such as the toy characters 410*a*, 410*b*.

In some embodiments, other techniques and structures may be used to adapt the toy vehicle 100 for use with two or more sizes of toy characters. For example, the seat space 210 may include a removable false floor or floor pan. When inserted, the false floor can define a leg height (e.g., the distance between the top of the seat and the floor where feet would rest) that is appropriate for relatively shorter toy occupants. When removed, additional space can be revealed to define a different, taller leg height that is appropriate for relatively taller toy occupants. In another example, the floor of the seat space 210 may be moveable or retractable within the vehicle body 110. For example, the floor may be spring-loaded to a first position that emulates a relatively shorter leg height, and then depressed into the vehicle body to emulate a relatively taller leg height.

In some embodiments, the character seat assemblies 250, 270 can be part of a single assembly. For example, the character seat assemblies 250, 270 can be affixed to each other bottom-to-bottom as a combined seat assembly. In use, the combined seat assembly could be inserted into an appropriately adapted seat space with the character seat assembly 250 facing upward to provide seating and with the character seat assembly 270 facing downward to become hidden within the seat space. The combined seat assembly could then be removed and reversed such that the character seat assembly 270 faces upward and the character seat assembly 250 becomes hidden.

In some embodiments, one of the character seat assemblies 250, 270 can be defined as an integral part of the seat space 210, and the other of the character seat assemblies 250, 270 can be formed as an adapter that can be removably assembled to the seat space 210, partly or entirely over the integral seat. For example, the character seat assembly 270 may be a substantially permanent part of the vehicle body 110, and the character seat assembly 250 can be formed as a cap or cover that adapts the character seat assembly 270 for use with smaller toy occupants.

Figure 13:
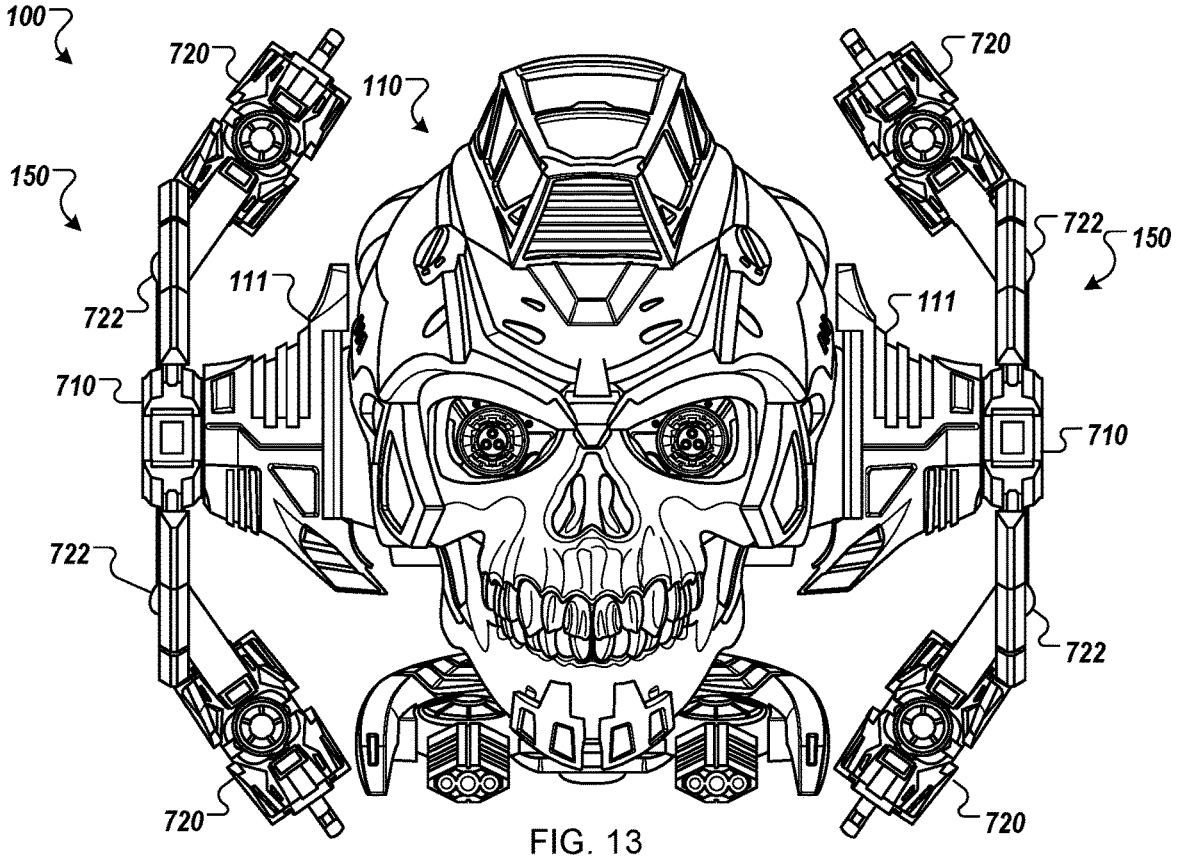
FIG. 13 is a front view of the example toy vehicle of FIG. 1 with a different example wing configuration.

FIGS. 7-12 are various plan views of the example toy vehicle 100 of FIG. 1. In the illustrated examples, the wing assemblies 150 are shown affixed to the sides 111 of the vehicle body 110 at a pair of pivot mounts 710 that will be discussed further in the description of FIG. 14. Each of the wing assemblies 150 includes a pair of nacelle sections 720. Each of the nacelle sections 720 is moveably affixed to their respective wing assembly 150 by a hinge assembly 722. The hinge assemblies 722 are configured to permit the nacelle sections 720 to be aligned with or partly tilted into or out of a primary plane of the wing assemblies. FIGS. 7-12 show the nacelle sections 720 tilted partly away from the vehicle body 110 (e.g., "attack" configuration). Referring briefly to FIG. 13, the nacelle sections 720 are shown tilted partly inward toward the vehicle body 110 (e.g., "tight maneuvering" or "close quarters" configuration).

Each of the wing assemblies 150 also includes a pair of winglets 152. Each of the winglets 152 is moveably affixed to the wing assemblies by a hinge assembly 154. The winglets 152 are configured to be moved between an inward or retracted (e.g., "flight") configuration relative to the wing assemblies 150, as shown in FIGS. 1 and 5A-12, and an outward or extended (e.g., "landing") configuration as shown in FIG. 14.

Figure 14:
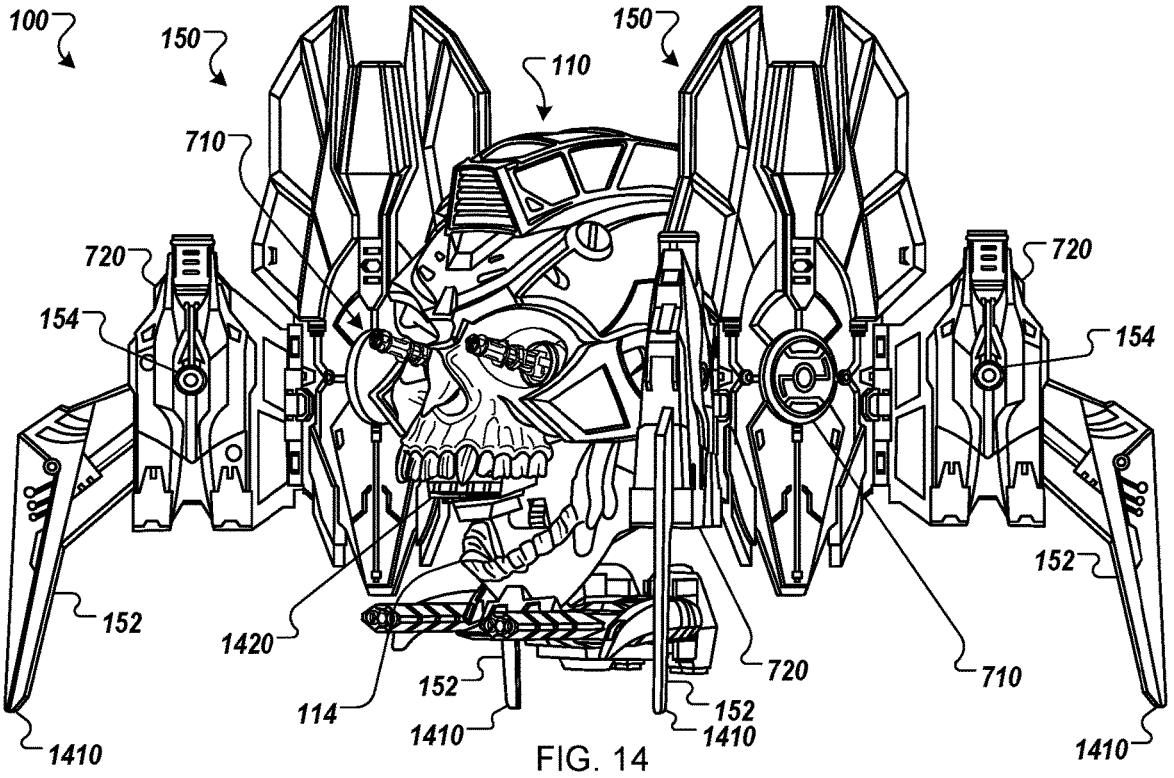
FIG. 14 is a perspective view of the example toy vehicle of FIG. 1 with different example wing and mouth configurations.

FIG. 14 is a perspective view of the example toy vehicle 100 of FIG. 1 with different example wing and mouth configurations. As discussed previously in this document, the wing assemblies 150 are affixed to the sides 111 of the vehicle body 110 at a pair of pivot mounts 710. The pivot mounts 710 are configured to permit rotation of the wing assemblies 150 relative to the vehicle body 110. In the illustrated example, the wing assemblies 150 are shown rotated into a substantially vertical (e.g., "landing") configuration relative to the vehicle body 110, whereas FIGS. 1, and 5A-13 show example configurations in which the wing assemblies 150 are in a substantially horizontal orientation (e.g., "flight" configuration).

In the illustrated example, the winglets 152 are shown in an outward or extended (e.g., "landing") configuration. For example, with the wing assemblies 150 rotated vertically and the winglets 152 extended as shown in FIG. 14, the toy vehicle 100 can rest on a flat surface contacted by tips 1410 of the winglets 152 and the vehicle body 110 can be supported in an upright orientation (e.g., the skull can "look" forward), emulating a landed spacecraft.

In the illustrated examples of FIGS. 1-2, and 5A-13, the jaw assembly 114 is shown in a closed configuration. In the illustrated example of FIG. 14, the jaw assembly 114 is shown in an open configuration. The jaw assembly 114 is configured to hingedly move (e.g., upon the jaw hinge 520, not visible in this view) between the closed and open configuration. The jaw assembly 114 is configured to conceal a payload when closed and reveal the payload when opened. In the illustrated example, the jaw assembly 114 is open to reveal an emulated missile launcher 1420. In some embodiments, the jaw assembly can open to provide a mount for additional accessories. For example, an accessory that emulates the appearance of flames (e.g., as produced from a flamethrower) can be affixed to the vehicle body 110 through the open jaw assembly 114 to emulate the appearance of flames as they might appear if produced by a flamethrower (e.g., "breath of fire" weapon).

Figure 15:
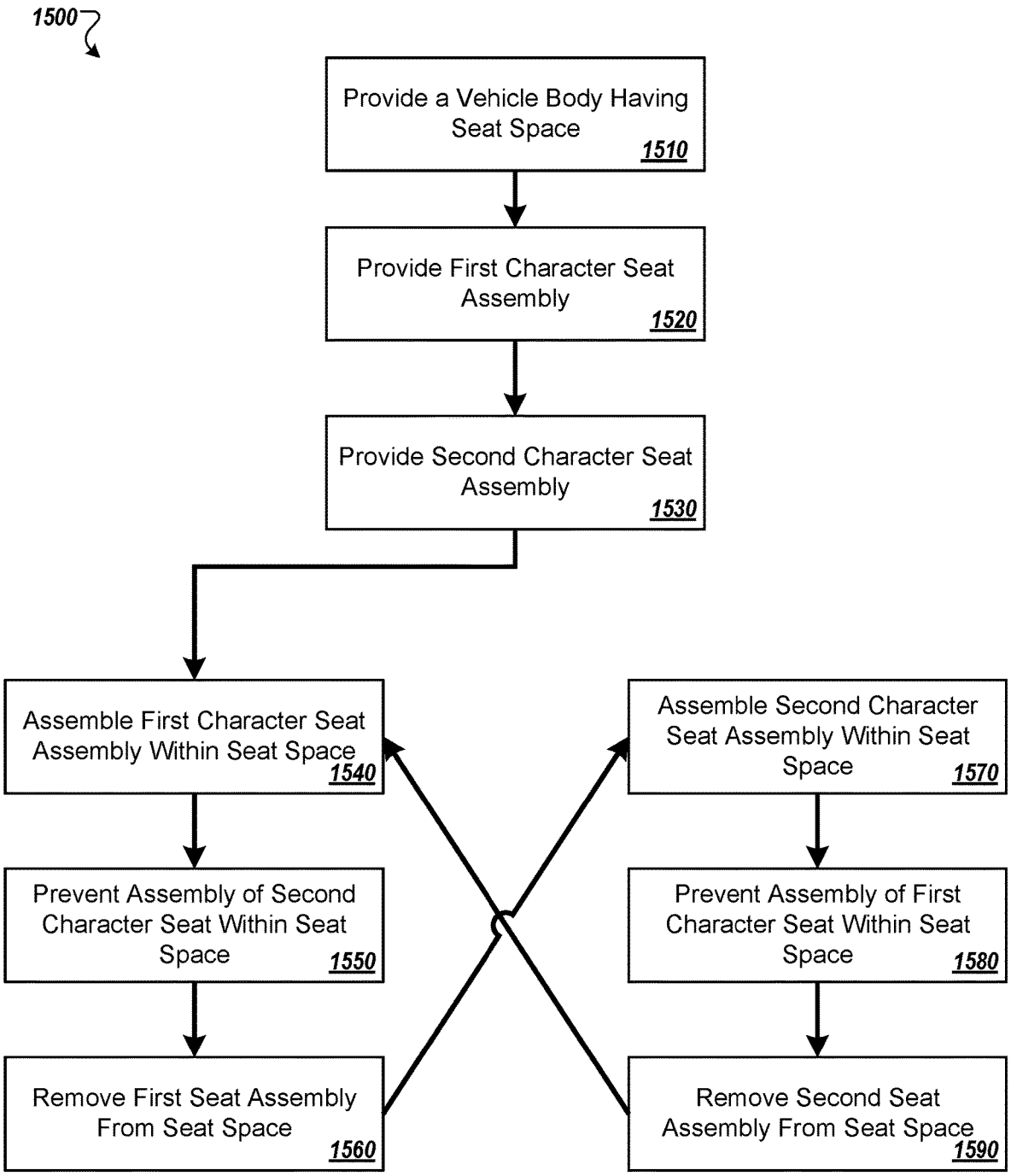
FIG. 15 is a flow diagram of an example process for using the example toy vehicle of FIG. 1.

FIG. 15 is a flow diagram of an example process 1500 for using the example toy vehicle 100 of FIGS. 1-14.

At 1510, a vehicle body is provided. The vehicle body defines a seat space that is at least partially enclosed and defines an interior volume to contain one or more character figures. For example, the example vehicle body 110 includes the seat space 210.

At 1520, a first character seat assembly is provided. For example, the example character seat assembly 250 can be provided.

At 1530 a second character seat assembly is provided. For example, the example character seat assembly 270 can be provided.

At 1540, the first character seat assembly is assembled within the seat space as a first simulated seat. For example, the example character seat assembly 250 can be assembled to the vehicle body 110 within the seat space 210 to emulate a seat.

In some implementations, the process 1500 can include arranging a first simulated anthropomorphic vehicle occupant upon the first simulated seat, where the first simulated seat is configured with a scale that is proportional to the first simulated anthropomorphic vehicle occupant. For example, the toy character 310 can be seated upon the simulated seat 252.

At 1550 the assembly of the first character seat assembly within the seat space prevents assembly of the second character seat assembly within the seat space. For example, when the character seat assembly 250 is arranged within the seat space 210, the character seat assembly 270 is effectively prevented from also being assembled to the vehicle body 110.

At 1560, the first character seat assembly is removed from the seat space. For example, the character seat assembly 250 can be removed from the seat space 210.

At 1570, the second character seat assembly is assembled to the vehicle body as a second simulated seat. For example, the character seat assembly 270 can be assembled to the vehicle body 110 within the seat space 210 (e.g., vacated by the removal of the character seat assembly 250 in step 1560).

In some implementations, the process 1500 can include arranging a second simulated anthropomorphic vehicle occupant upon the second simulated seat, where the second simulated seat is configured with a scale that is proportional to the second simulated anthropomorphic vehicle occupant. For example, the toy character 410*a* can be seated upon the simulated seat 272*a*.

In some implementations, the process 1500 can include arranging a third simulated anthropomorphic vehicle occupant upon a third simulated seat, where the second modular seat assembly includes the third simulated seat configured with a scale that is proportional to the third simulated anthropomorphic vehicle occupant. For example, the character seat assembly 270 includes both the simulated seat 272*a* and the simulated seat 272*b*, and the toy character 410*b* can be seated upon the simulated seat 272*b* while the toy character 410*a* can be seated upon the simulated seat 272*a*.

At 1580, the assembly of the second character seat assembly within the seat space prevents assembly of the first character seat assembly within the seat space. For example, when the character seat assembly 270 is arranged within the seat space 210, the character seat assembly 250 is effectively prevented from also being assembled to the vehicle body 110.

At 1590, the second character seat assembly is removed from the seat space. For example, the character seat assembly 270 can be removed from the seat space 210.

In some implementations, the process 1500 can include opening a door of the seat space defined by the vehicle body configured as a simulated cockpit of the modular vehicle, the door being configured to open to provide access to the seat space, and closing the door to at least partly enclose the first modular seat assembly or the second modular seat assembly within the seat space. For example, the cockpit door 120 can be hinged open to provide access to the seat space 210, and then closed again to partly enclose the character seat assembly 250 or the character seat assembly 270 inside to simulate a cockpit and canopy of the toy vehicle 100.

Although two approximate scales have been discussed in this document (e.g., 1:18 and 1:12), the toys and seat assemblies described herein can be scaled to accommodate toy occupants of any appropriate size. For example, the seat assemblies could be configured to accommodate very small occupants (e.g., about 1:60 scale miniatures or smaller). In another example, the seat assemblies could be configured to accommodate large toy occupants (e.g., about 1:4 scale toys or larger). In yet another example, the seat assemblies could be configured for full-scale occupants (e.g., a ride-on vehicle with one seat assembly that could seat a person and another seat assembly, interchangeable with the first, which could seat an action figure, doll, or mannequin in the same vehicle).

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A modular toy vehicle comprising:

a toy vehicle body defining a seat space that is at least partially enclosed and defines an interior volume to contain one or more toy character figures;

a first toy character seat assembly removably mountable to the toy vehicle body within the seat space as a first simulated seat having a first miniaturized scale size proportional to a first simulated anthropomorphic toy occupant having a first scale of no larger than 1:4; and a second toy character seat assembly removably mountable to the toy vehicle body within the seat space as a second simulated seat having a second miniaturized scale size proportional to a second simulated anthropomorphic toy occupant having a second scale smaller than the first scale, the second simulated seat being sized differently from the first simulated seat such that the second toy character seat assembly is prevented from removably mounting to the toy vehicle body within the seat space when the first toy character seat assembly is removably mounted to the toy vehicle body within the seat space.

2. The modular toy vehicle of claim 1, wherein the seat space of the toy vehicle body is sized to interchangeably receive a selected one of the first toy character seat assembly and the second toy character seat assembly.

3. The modular toy vehicle of claim 2, wherein the interior volume defined by the seat space is a fixed interior volume bounded by one or more fixed walls of the toy vehicle body, and the fixed interior volume limits insertion of the second toy character seat assembly within the seat space when the first toy character seat assembly is removably mounted to the toy vehicle body within the seat space.

4. The modular toy vehicle of claim 3, wherein the seat space defined by the toy vehicle body simulates a vehicle cockpit configured to receive the one or more toy character figures associated with the toy vehicle body.

5. The modular toy vehicle of claim 4, further comprising a door configured to open to provide access to the seat space and close to at least partly enclose the seat space.

6. The modular toy vehicle of claim 4, wherein the toy vehicle body has an exterior shape of a winged spacecraft that includes one or more adjustable wing assemblies.

7. The modular toy vehicle of claim 3, wherein:

the toy vehicle body comprises a collection of one or more first attachment points within the seat space;

the first toy character seat assembly comprises a collection of one or more second attachment points configured to releasably connect with one or more of the first attachment points for removably mounting the first toy character seat assembly to the toy vehicle body; and the second toy character seat assembly comprises a collection of one or more third attachment points configured to releasably connect with one or more of the first attachment points for removably mounting the second toy character seat assembly to the toy vehicle body.

8. The modular toy vehicle of claim 1, wherein the first simulated seat is sized to receive the first simulated anthropomorphic toy occupant having the first scale of about 1:12.

9. The modular toy vehicle of claim 1, wherein the first simulated anthropomorphic toy occupant has a height of about five inches to about seven inches.

10. The modular toy vehicle of claim 1, wherein the second simulated seat is sized to receive the second simulated anthropomorphic toy occupant having the second scale of about 1:18.

11. The modular toy vehicle of claim 1, wherein the second simulated anthropomorphic toy occupant has a height of about 3.5 inches and about 4.25 inches.

12. The modular toy vehicle of claim 1, wherein the second toy character seat assembly further defines both the second simulated seat and a third simulated seat.

13. A method of assembling a modular toy vehicle, the method comprising:

providing a toy vehicle body defining a seat space that is at least partially enclosed and defines an interior volume to contain one or more toy character figures;

providing a first toy character seat assembly having a first simulated seat having a first miniaturized scale size proportional to a first simulated anthropomorphic toy occupant having a first scale of no larger than 1:4;

providing a second toy character seat assembly having a second simulated seat having a second miniaturized scale proportional to a second simulated anthropomorphic toy occupant having a second miniaturized scale size smaller than the first miniaturized scale size, the second simulated seat being sized differently from the first simulated seat;

assembling the first toy character seat assembly having the first simulated seat within the seat space;

preventing, by the assembly of the first toy character seat assembly within the seat space, assembly of the second toy character seat assembly within the seat space;

removing the first toy character seat assembly from the seat space;

assembling the second toy character seat assembly having the second simulated seat to the toy vehicle body;

preventing, by the assembly of the second toy character seat assembly within the seat space, assembly of the first toy character seat assembly within the seat space; and removing the second toy character seat assembly from the seat space.

14. The method of claim 13, further comprising arranging the first simulated anthropomorphic toy occupant upon the first simulated seat, wherein the first simulated seat is configured with a scale that is proportional to the first simulated anthropomorphic toy occupant.

15. The method of claim 13, further comprising arranging the second simulated anthropomorphic toy occupant upon the second simulated seat, wherein the second simulated seat is configured with a scale that is proportional to the second simulated anthropomorphic toy occupant.

16. The method of claim 15, further comprising arranging a third simulated anthropomorphic toy occupant upon a third simulated seat, wherein the second toy character seat assembly comprises the third simulated seat configured with a third miniaturized scale size that is proportional to the third simulated anthropomorphic toy occupant.

17. The method of claim 13, further comprising:

opening a door of the seat space defined by the toy vehicle body configured as a simulated cockpit of the toy modular vehicle, the door being configured to open to provide access to the seat space; and closing the door to at least partly enclose the first toy character seat assembly or the second toy character seat assembly within the seat space.

* * * * *